United States Patent [19]

Fender

[11] Patent Number: 4,837,987

[45] Date of Patent: Jun. 13, 1989

[54] RAIN WATER RECEIVING APPARATUS WITH DUMPING FEATURE

[76] Inventor: Ronald V. Fender, 200 Falls St., Morganton, N.C. 28655

[21] Appl. No.: 244,997

[22] Filed: Sep. 15, 1988

[51] Int. Cl.[4] ..... E04D 13/04

[52] U.S. Cl. ..... 52/11

[58] Field of Search ..... 52/11, 16; 405/119

[56] References Cited

U.S. PATENT DOCUMENTS

| | | |
|---|---|---|
| 510,515 | 12/1893 | McKenney . |
| 538,108 | 4/1895 | Freeze . |
| 4,061,151 | 12/1977 | Ward . |
| 4,116,008 | 9/1978 | Ward . |
| 4,117,635 | 10/1978 | Nelson . |
| 4,413,449 | 11/1983 | Faye . |

*Primary Examiner*—John E. Murtagh

*Attorney, Agent, or Firm*—Bell, Seltzer, Park & Gibson

[57] ABSTRACT

This invention is directed to a gutter apparatus for directing rain water to a downspout that is particularly adapted to be inverted to permit debris collected in the gutter to fall therefrom. The gutter apparatus includes a rod that defines a rotational axis which is supported by a plurality of fixed supporting brackets to extend along a lower edge of the roof at a spaced distance therefrom. A plurality of supports fixed to the rod mount the gutter trough to the rod so that gutter trough may be rotated from an upright operational position to an inverted dumping position. The gutter is rotated by a rotatable drive means which is operated by a person positioned safely on the ground.

12 Claims, 5 Drawing Sheets

RAIN WATER RECEIVING APPARATUS WITH DUMPING FEATURE

FIELD OF THE INVENTION

This invention relates to a gutter apparatus for directing rain water from a sloped roof to a downspout, and which may be easily cleaned, or more particularly to a gutter apparatus that is able to be inverted to permit any debris collected therein to fall from the gutter.

BACKGROUND OF THE INVENTION

It is a well known problem that rain gutters for receiving rain water from a sloped roof and directing it to a downspout continually collect leaves and other debris that eventually plug the downspout and allow rain water to spill over the edge of the gutter. Conventional practice is to clean the gutters by raising a ladder up to the roof and cleaning out the debris by hand. A garden hose is sometimes used as a supplement to wash the remaining debris into and down the downspout. A garden hose is also used to help force an accumulation of debris plugging the downspout out through the bottom. Climbing the ladder to clean the gutters, however, is a dangerous job that in some cases, requires a climb as high as the second or third story above the ground. At the top of the ladder the person cleaning the gutters often will reach out to the side that tends to make the ladder unstable. Climbing a ladder to clean the gutters is particularly dangerous if the house has a sloped yard which makes the ladder less stable.

Gutter systems have been developed which permit remote dumping of the collected debris from the gutter. Examples of such systems include U.S. Pat. Nos. 510,515; 538,108; 4,061,151; 4,116,008; and 4,413,449. Each of these systems allow a trough which normally collects rain water and directs it to a downspout to be inverted and allow debris to be removed therefrom. While each of these patented systems have their own particular attributes, they have certain common features which effectively limit their utility and add to the cost of an installation over and above the installation of a conventional gutter system. For example, U.S. Pat. No. 538,108 to Freeze shows a series of brackets spaced along a lower edge of the roof for supporting the trough. Hinges are provided on the outer edge of the brackets attached to the trough which allow the trough to rotate up and over the edge of the brackets. In this arrangement the gutter trough must be made of a material having substantial strength and rigidity in order to withstand the torsional stress related to rotating the trough. This is particularly important if the trough extends for a substantial distance. The other references similarly apply the rotational torque to the trough which means that a strong trough is required by the systems. Clearly, such a strong material is heavy, bulky and expensive.

A further problem associated with the gutters disclosed in certain of the above patents is that the gutters rotate up and over the hinges. This means that the design must have some clearance between the lower edge of the roof and the trough. Such a design allows for gaps between the trough and the roof, and such gaps may allow water to run behind the gutter.

Accordingly, it is an object of the present invention to provide a rain gutter apparatus which is able to be inverted to permit any debris collected therein to fall therefrom and which avoids the disadvantages of the prior art constructions as noted above.

It is a more particular object over the present invention to provide an inexpensive and effective rain gutter apparatus which is able to be inverted to permit any debris collected therein to fall therefrom and which does not put a torsional load on the gutter trough.

SUMMARY OF THE INVENTION

The above and other objects of the invention have been achieved by the provision of an apparatus for receiving rain water from the lower edge of a sloped roof and directing the rain water to a downspout, and which comprises a plurality of fixed supporting brackets mounted at spaced intervals along the lower edge of the sloped roof, and an elongate rod rotatably supported by said fixed supporting brackets. The elongate rod extends along the lower edge of the sloped roof at a spaced distance therefrom and defines a rotational axis. An elongate trough having a generally U-shape in cross-section is mounted by mounting means to the rod so that the trough extends parallel to the rotational axis of the rod and the mounting means is rotatable with the rod about the axis. A rotatable drive means is connected to the rod for rotating the rod and trough about the rotational axis and between an operative position and a dumping position. In the operative position, the trough is upright and adapted to receive the rain water from the lower edge of the roof. In the dumping position, the trough is inverted to permit debris to fall therefrom. The above construction provides that the rotatable drive means drives the rod, and so that the rotational torque is transmitted essentially by the rod and not by the trough.

The apparatus may be adapted to receive rain water from a pair of intersecting roof sections which have lower edges that intersect one another such as in the case of a hip roof. In this case, the trough along one lower edge has a portion which extends around the intersection of the lower edges into fluid communication with the trough along the other lower edge. Also, both trough sections are preferably rotatable between the above described operative and inoperative positions.

BRIEF DESCRIPTION OF THE DRAWINGS

Some of the features and advantages of the invention having been stated, others will become apparent as the description proceeds when taken in conjunction with the accompanying drawings in which.

DETAILED DESCIRPTION OF THE PREFERRED EMBODIMENTS

Figure 1:
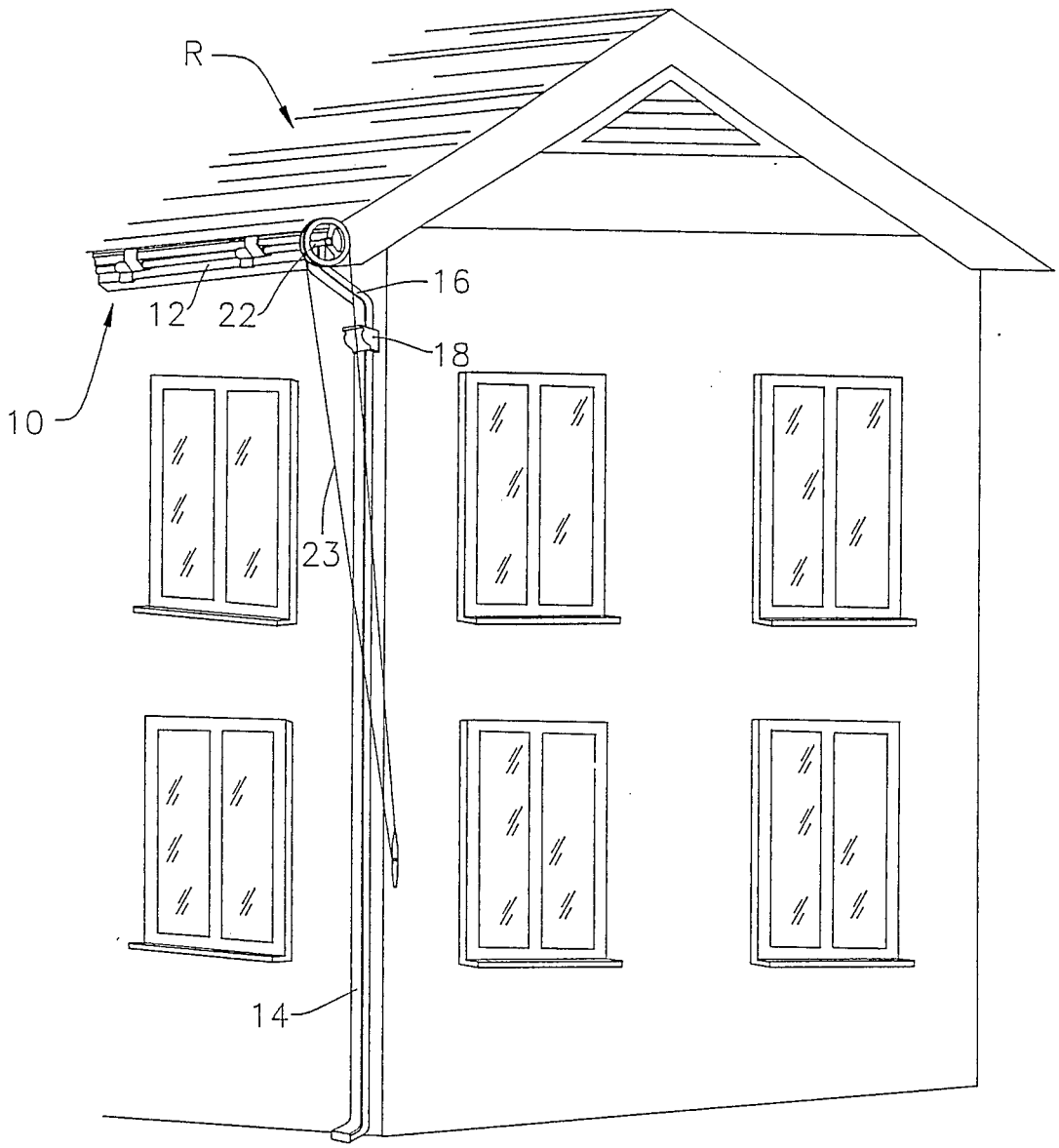
FIG. 1 is a perspective view of a house with a sloped roof and a gutter apparatus embodying the features of the present invention attached to the lower edge of the sloped roof.

Referring now more particularly to the drawings, FIGS. 1–5 illustrate a first embodiment of the gutter apparatus incorporating the features of the present invention. The gutter apparatus is generally indicated by the numeral 10 and is shown positioned at the lower edge of the roof R. The gutter apparatus 10 comprises an elongate trough 12 which receives the rain water therein and delivers it to a downspout segment 16. The downspout segment 16 delivers water to a fixed downspout 14 which includes a downspout entrance receptacle 18.

Figure 2:
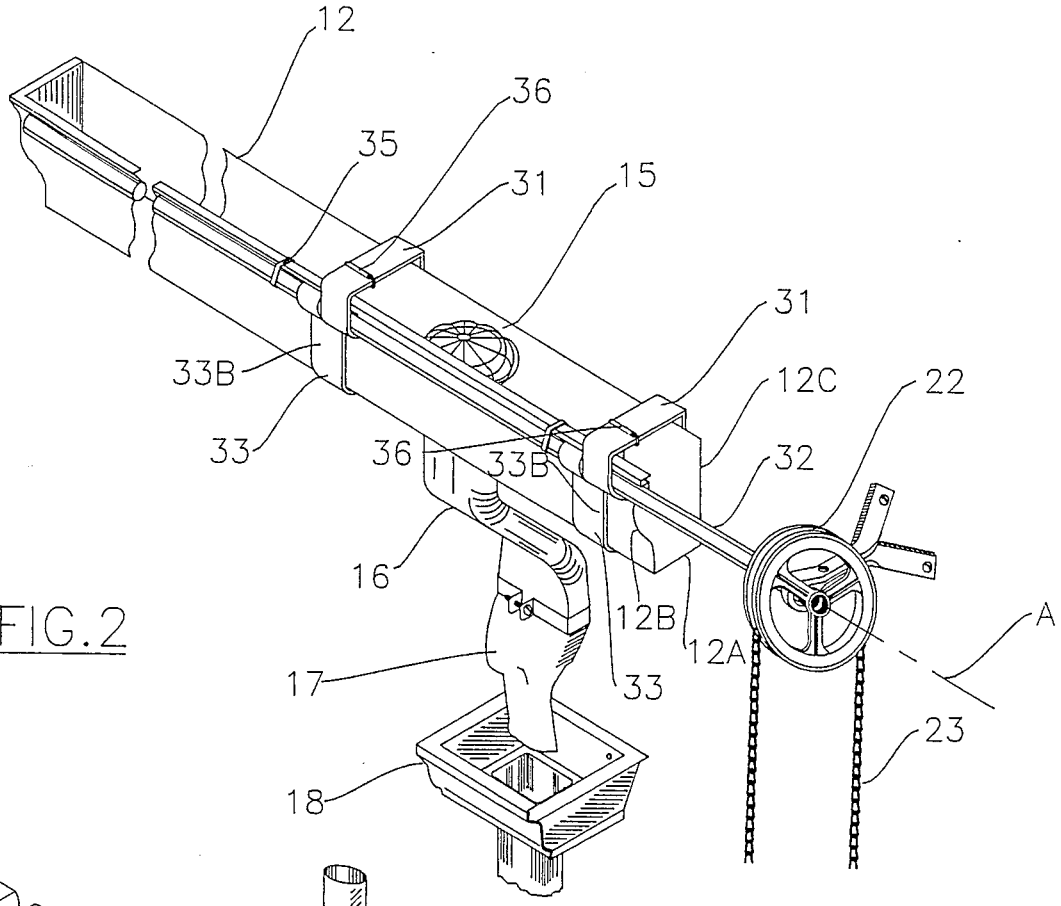
FIG. 2 is a perspective view of the gutter apparatus in the upright operative position, the roof and house structure having been removed for clarity of illustration.
Figure 4:
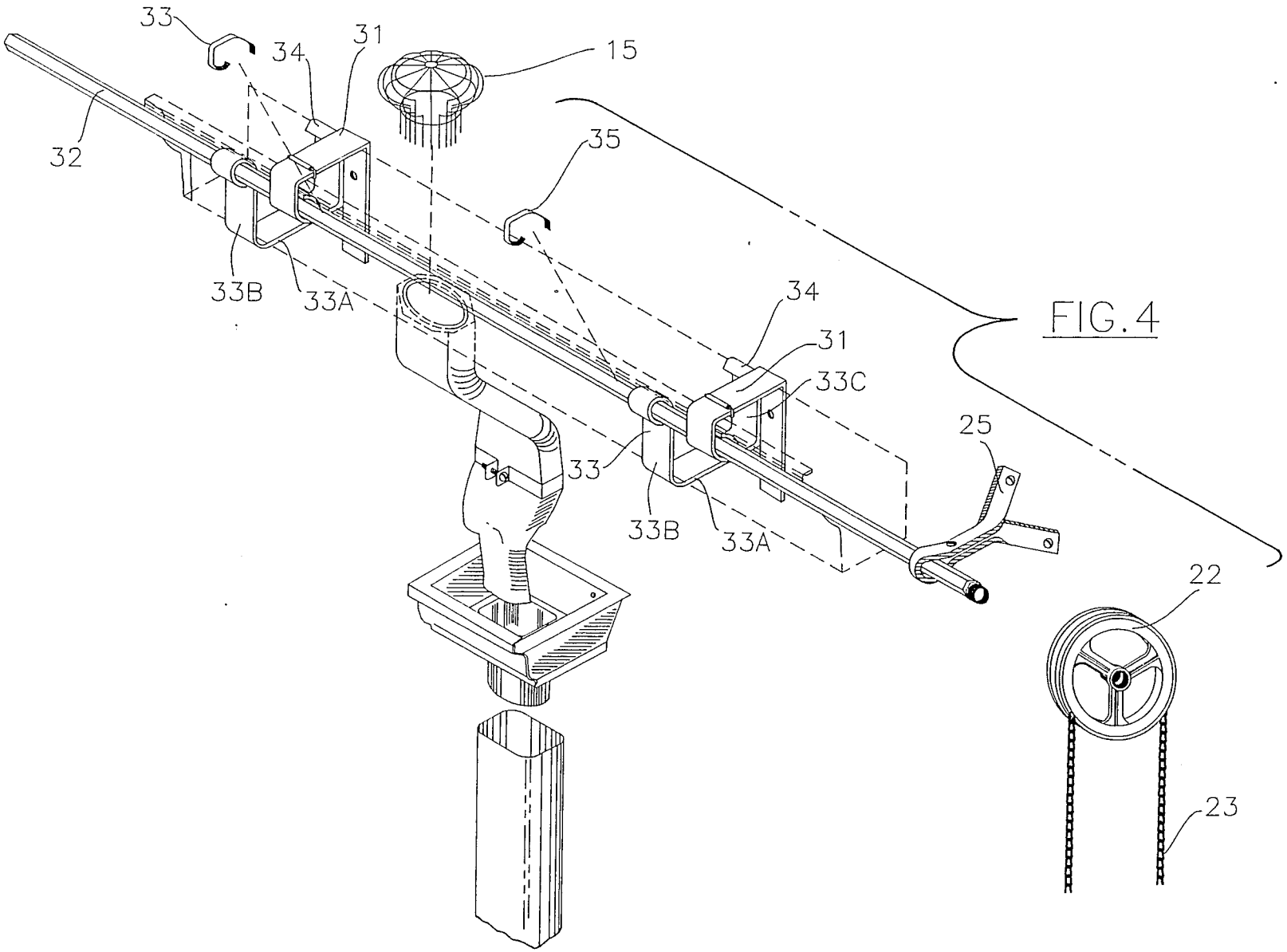
FIG. 4 is an exploded perspective view of the gutter apparatus with the gutter trough shown in broken lines to more clearly illustrate the hardware of the system, and with the roof and house structure having been removed for clarity of illustration.

Referring particularly to FIGS. 2 and 4, the gutter apparatus comprises a series of fixed supporting brackets 31 which are attached to the lower edge of the sloped roof. The fixed supporting brackets 31 must be strong and sturdy and may be formed of sheet steel or other suitable material. Rotatably supported by an inturned lip at the outer end of each of the fixed brackets 31 is an elongate rod 32 which extends horizontally along the lower edge of the roof at a spaced distance therefrom, and so as to define a rotational axis A. The mounting means for the rod 32 may include an additional bracket 25 positioned immediately adjacent the wheel 22. The elongate rod 32 is preferably a hex shaped steel rod having substantially torsional strength. Attached to the end of the rod 32 is a rotatable drive means taking the form of a wheel 22 with an endless chain 23 overlying the wheel. The chain 23 extends downwardly and is arranged to be accessible to a person on the ground. Therefore, a person on the ground by pulling on one of the chain lengths may rotate the wheel and rod which is located at the edge of the roof and out of reach. Other suitable rotatable drive means such as a gear box or motor may be used to rotate the rod 32 as desired.

A series of supports 33 are fixedly mounted to the rod 32 at spaced intervals and so as to rotate therewith. The supports 33, like the brackets 31, may be formed of sheet steel so that they are substantially rigid and of strong construction. The supports 33 are also formed to have a generally U-shape and outline so as to define a bottom segment 33A and opposite side segments 33B, 33C, and they collectively receive the trough 12 mounted therein. The trough is also generally U-shaped in cross section so as to define a bottom wall 12A and opposite side walls 12B, 12C. The bottom segment 33A and opposite side segments 33B, 33C of the supports 33 are arranged to respectively overlie the bottom wall 12A and opposite side walls 12B, 12C of the trough.

Means are also provided for mounting the trough 12 to the supports 33, and thus to the rod 32, so that the trough extends parallel to the rotational axis A of the rod and is rotatable with the rod about such axis. More particularly, this mounting means includes an integral inturned lip 34 on the side segment 33C of each of the supports 33, and so that the lip 34 overlies the upper edge of the side wall 12C. Also, a releasable clip 35 interconnects the rod 32 with the other side wall 12B so that the trough 12 is securely attached to supports 33.

Attached to the brackets 31 are water deflectors 36. The water deflectors 36 deflect rain water that runs down the roof and onto the bracket 31 and which might otherwise run all the way across the trough 12. One of the deflectors 36 is particularly illustrated in FIG. 5, and they are formed to span the brackets 31 with a raised body portion of plastic or similar material. More particularly, each deflector 36 may be comprised of a segment of wire with ends clipped to the bracket as illustrated, or each may be comprised of an elastic band such as an O-ring.

Figure 3:
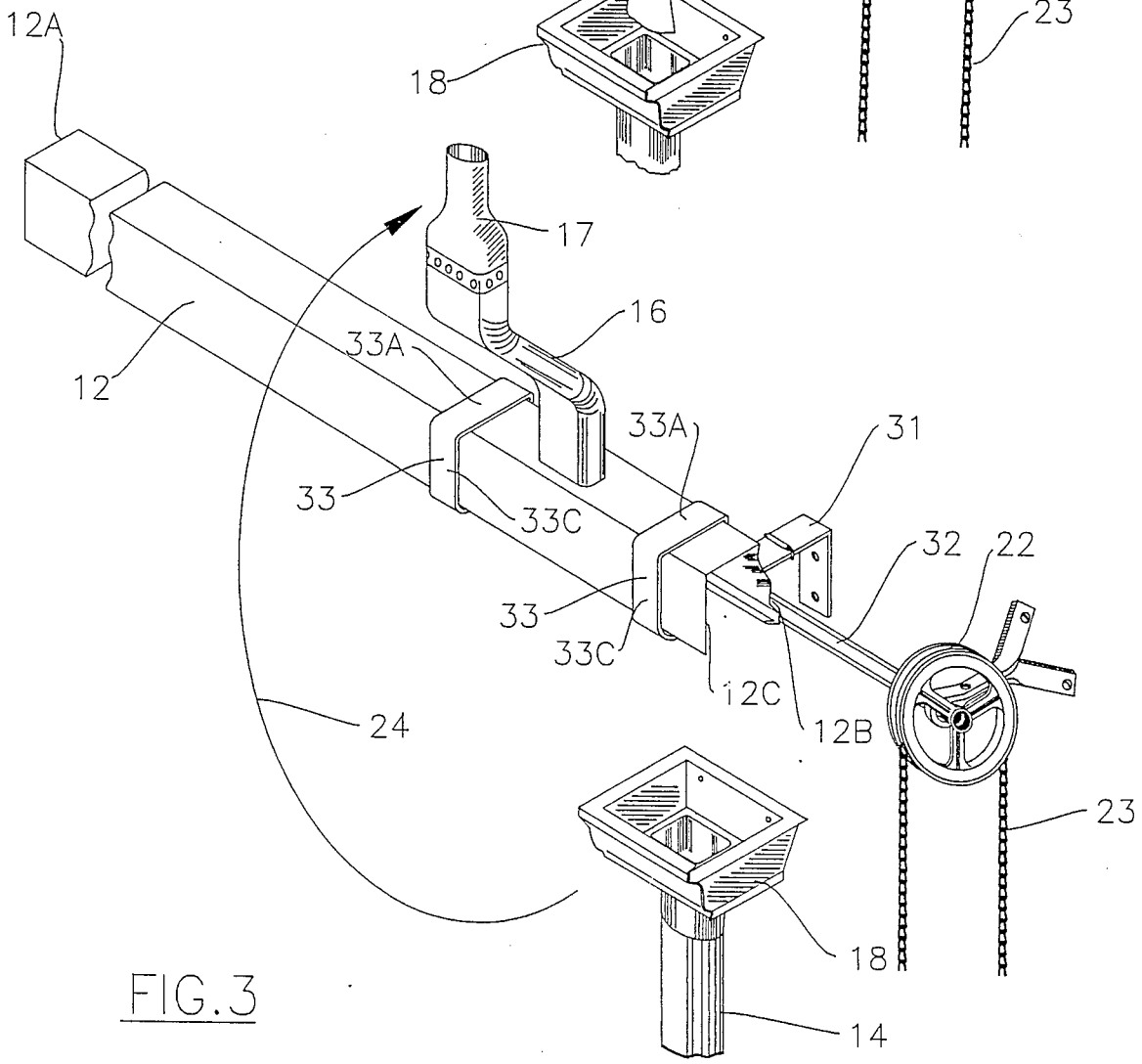
FIG. 3 is a perspective view of the gutter apparatus similar to FIG. 2 but showing the gutter in the inverted dumping position.

As best shown in FIGS. 2 and 3, the trough 12 is rotatable between an operative position (FIG. 2) wherein the trough is upright and adapted to receive rain water from the lower edge of the roof, and a dumping position (FIG. 3) wherein the trough is inverted to permit debris to fall therefrom. Also, it will be seen that the trough is rotated by the elongate rod 32 under and around axis A, as indicated by arrow 24, into the inverted dumping position. A garden hose may be used with a jet spray to remove any further debris adhering to the inverted trough. In this manner, the person cleaning the trough is located at all times safely on the ground. It should be noted that the trough is rotated down and away from the edge of the roof. This permits the trough to be located under a lip formed by the shingles so that rain water will not fall between the edge of the roof and the gutter. Also, rotating the trough into the dumping position permits easy access to the edge of the roof for painting or repairs, etc.

The downspout segment 16 is mounted to the bottom wall 12A of the trough so as to be in fluid communication with the trough, and so as to extend downwardly from the trough in its operative position. Also, a flexible lower end portion 17 is attached to the lower end of the downspout segment 16, to provide a flexible connector between the fixed downspout entrance receptacle 18 and segment 16, and so that the end portion 17 can extend into the receptacle 18. The flexible connector 17 is preferably composed of a flexible rubber tube that easily flips into and out of the receptacle 17 without permanently deforming. A bulbous wire screen 15 may be provided within the trough 12 over downspout segment 16 to prevent large objects such as sticks and twigs, which tend to clog a downspout, from going into the downspout segment 16.

Figure 6:
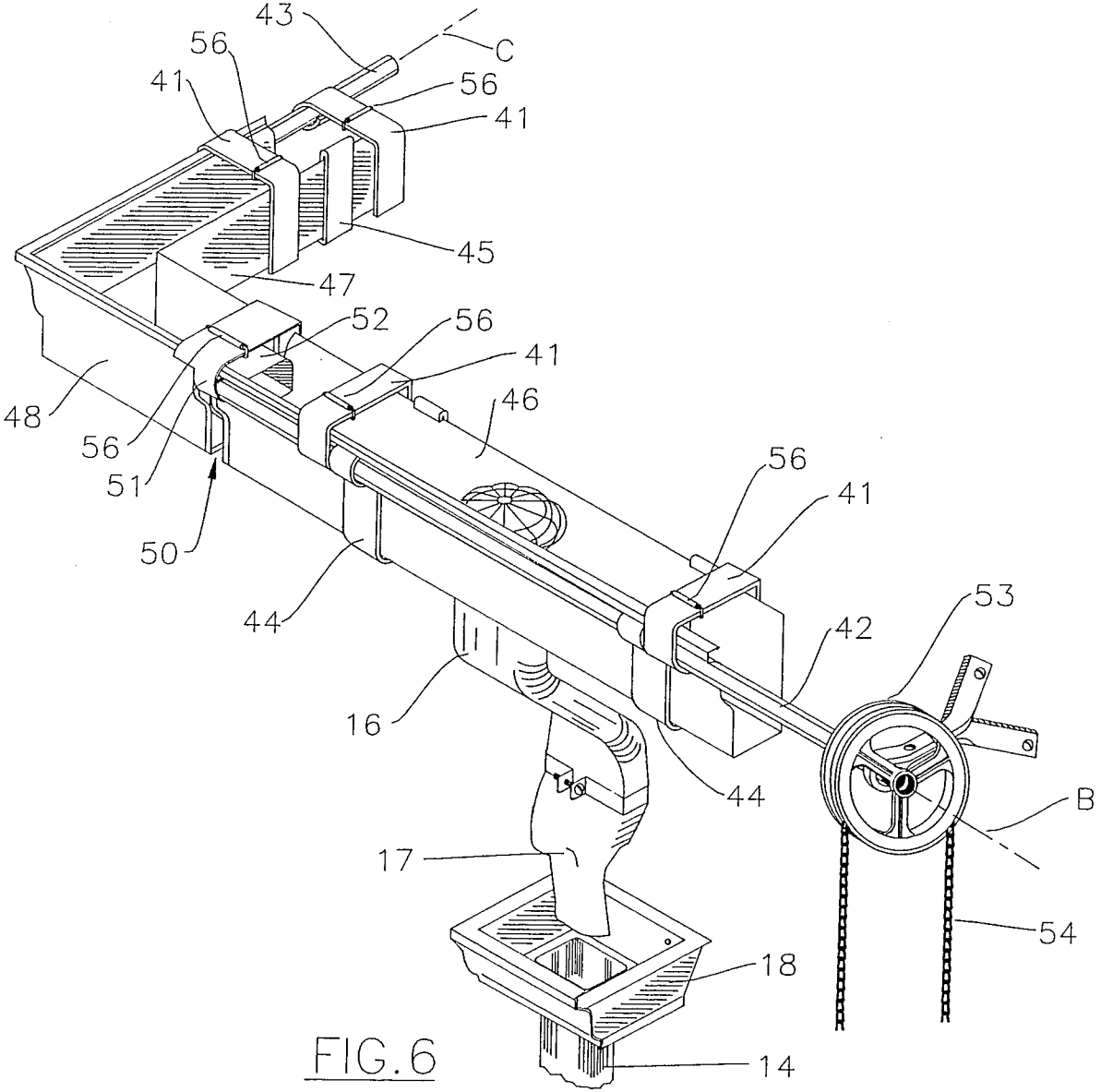
FIG. 6 is a perspective view of a second embodiment of the invention where the gutter apparatus extends around the corner of the roof as would be needed in the case of a hip roof.
Figure 5:
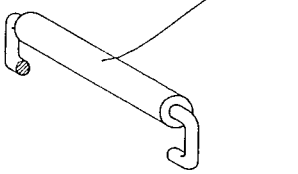
FIG. 5 is an enlarged perspective view of the water deflector which has been detached from the apparatus.
Figure 7:
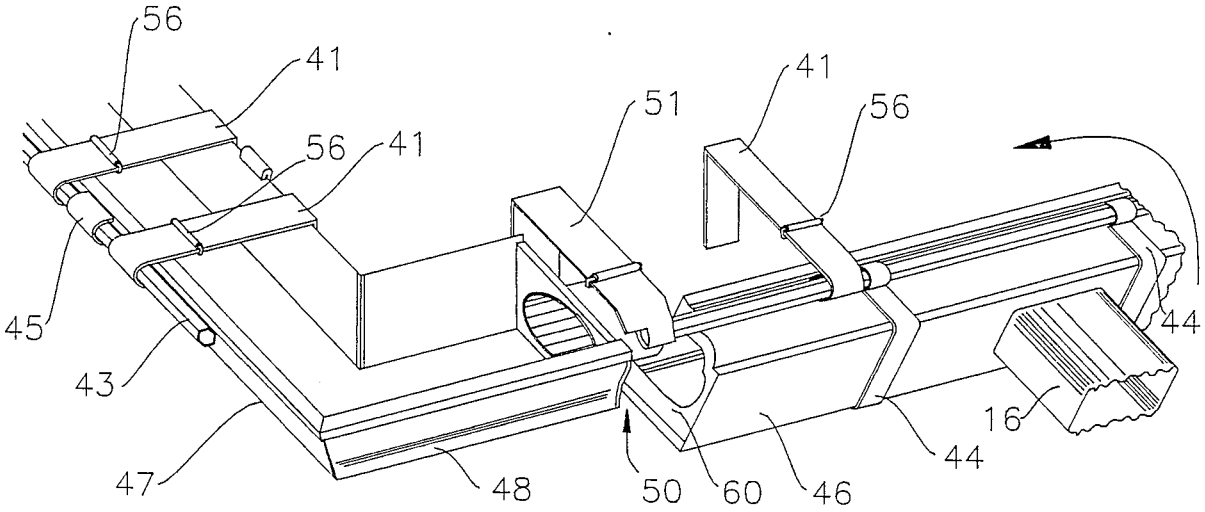
FIG. 7 is a perspective view of the second embodiment of the gutter apparatus showing the first step of the dumping operation.
Figure 8:
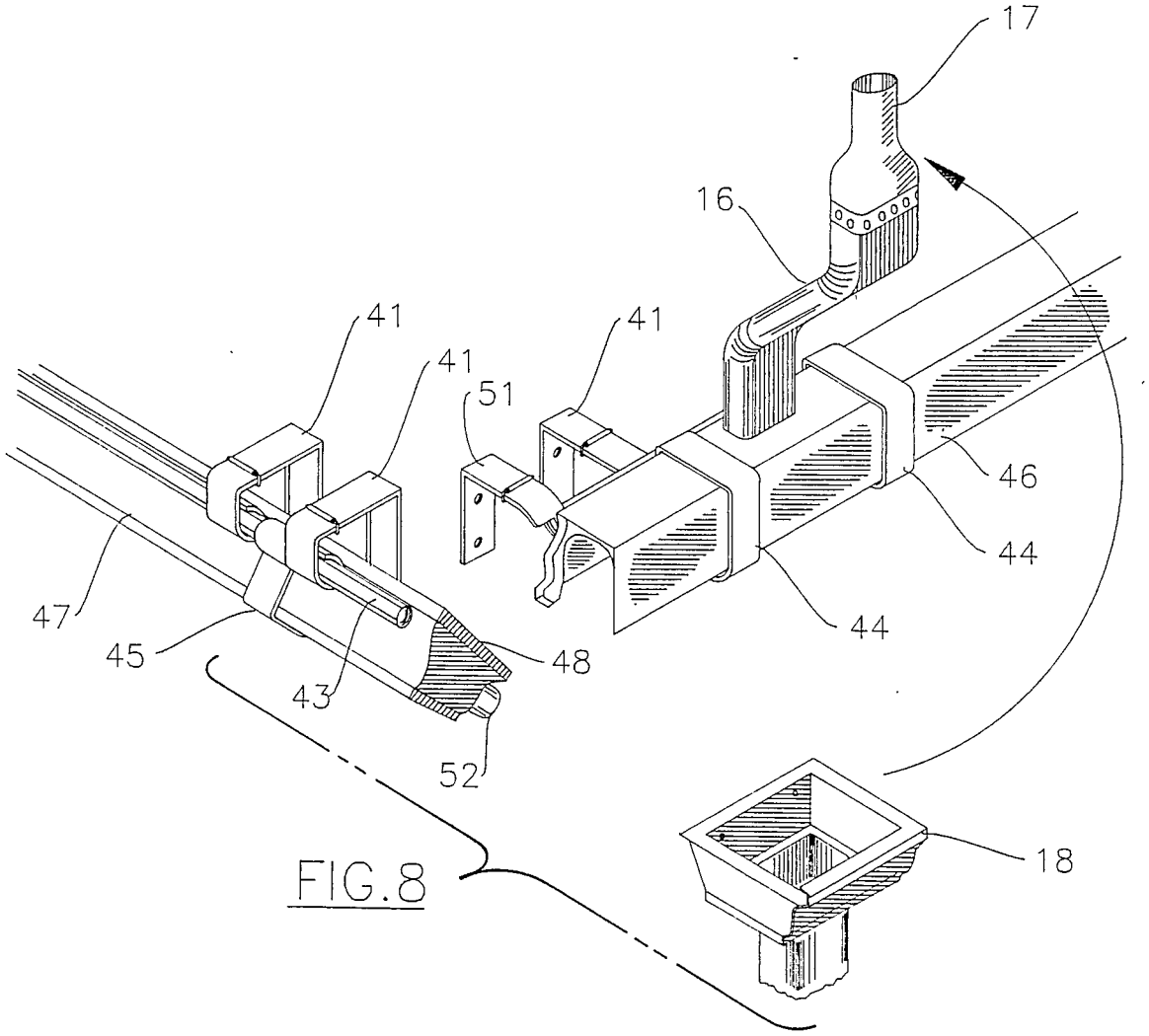
FIG. 8 is a perspective view of the second embodiment of the gutter system showing the complete rotation of one trough into the inverted dumping position and the partial rotation of a second trough toward its inverted dumping position.

A second embodiment of the invention is illustrated in FIGS. 6–8. The second embodiment is similar to the first embodiment except that it is intended to be used on a different style of roof, particularly styles composed of intersecting roof sections which have lower edges intersecting one another. For example, a hip roof has sloping portions along two adjacent roof sections which are divided by a sloping ridge. As such, hip roofs require a rain gutter along adjacent lower edges that intersect one another.

The gutter system of the second embodiment comprises a series of fixed supporting brackets 41 attached to the lower edges of the roof. An elongate rod 42 is rotatably supported by the fixed supporting brackets 41 such that the rod 42 extends along one lower edge of the roof at a spaced distance therefrom, and so as to define the rotational axis B. Similarly, a rod 43 is attached to fixed supporting brackets 41 along the other lower edge of the roof, and defines the rotational axis C. Attached to the end of rod 42 is a wheel 53 with a chain 54 overlying the wheel. A similar wheel or rotatable drive means (not shown) is arranged for rod 43. A series of supports 44 are fixedly attached to rod 42 at spaced intervals so as to rotate therewith. The supports which are similar to the supports 33 in the first embodiment are arranged to receive a trough 46. Similarly, supports 45 are fixedly mounted to the rod 43 at spaced intervals to rotate with rod 43. A trough 47 is arranged to be received in the series of supports 45. The trough 47 has an end portion 48 which extends around the intersection of the two lower edges of the roof, and the end portion 48 extends to a junction 50. Overlying junction 50 is a supporting bracket 51 which is rotatably connected to the rod 42 and which is constructed to be wider than the supporting brackets 41 so as to cover the junction. End portion 48 also mounts a tubular connector 52 which extends into the end of the adjacent trough 46 and provides fluid connection between the trough 46 and the trough 47. The end of the trough 46 at the junction 50 also includes a transverse end wall 60 (FIG. 7) which closely receives the tubular connector 52 when the troughs 46, 48 are in their operative positions as seen in FIG. 6, so as to prevent rain water from leaking out at the junction 50. Preferably, the end wall 60 of the trough 46 mounts a resilient gasket (not shown) which contacts the connector 52 to provide a good seal between the end wall and the connector 52. Water deflectors 56 are attached to the connecting brackets 41 and 51 to deflect water into the gutter that would otherwise travel over the edge of the fixed brackets.

In this embodiment, the troughs 46 and 47 are dumped sequentially. As illustrated in FIG. 7, trough 46 is rotated first to uncouple the connector 52 from the end wall 60 of the trough 46. Once the trough 46 is completely inverted as shown in FIG. 8, the trough 47 may be rotated to the dumping position. The troughs are returned to their operative positions by reversing this procedure.

There are many advantages to the particular arrangement and construction of the present invention. For example, the rods by which the gutter systems are rotated are strong and durable to handle the torque of the rotation. Thereby the gutter systems or the troughs themselves do not have to withstand the torsional stress. As such, conventional aluminum gutters which have minimal torsional strength may be used as the trough for this particular design. The brackets and the rod are made of very durable components which would probably outlast the aluminum gutter. The aluminum gutter troughs may be easily replaced by removing the clips 35 and rotating the gutter out from underneath the curved lips 34 of the rotating brackets 43.

The rod 32 (or 42,43) of the present invention also provides very strong and durable protection for the gutter. For instance, if a ladder or other object were to lean against the gutter, the rod would support the load. A conventional gutter could permanently bend and deform.

The foregoing description is to be considered illustrative rather than restrictive of the invention, and those modifications which come within the meaning and range of equivalence of the claims are to be included therein.

That which I claim is:

1. An apparatus for receiving rain water from the lower edge of a sloped roof and for directing the rain water to a downspout, and characterized by the ability to be inverted to permit any debris collected therein to fall therefrom, said apparatus comprising a plurality of fixed supporting brackets mounted at spaced intervals along the lower edge of the sloped roof;

an elongate rod rotatably supported by said fixed supporting brackets and extending along the lower edge of the sloped roof at a spaced distance therefrom, and so as to define a rotational axis;

an elongate trough having a generally U-shape in cross-section;

means mounting said trough to said rod so that the trough extends parallel to said rotational axis of said rod and is rotatable with said rod about said axis; and rotatable drive means connected to said rod for rotating said rod and said trough about said rotational axis and between an operative position wherein said trough is upright and adapted to receive rain water from the lower edge of the roof, and a dumping position wherein said trough is inverted to permit debris to fall therefrom, and such that the rotational torque is transmitted essentially by said rod and not by said trough.

2. The apparatus as defined in claim 1 wherein said trough includes a bottom wall and opposite side walls, and further comprising a downspout segment mounted to said bottom wall so as to be in fluid communication with said trough and so as to extend downwardly from said trough in said operative position thereof.

3. The apparatus as defined in claim 2 wherein said downspout segment includes a flexible lower end portion which is adapted to be received in and communicate with a fixedly mounted downspout entrance receptacle when said trough is in said operative position.

4. The apparatus as defined in claim 1 wherein said means mounting said trough to said rod comprises a plurality of supports fixedly mounted to said rod at spaced intervals along said rod and so as to rotate therewith about said rotational axis, and means interconnecting each of said supports to said trough.

5. The apparatus as defined in claim 4 wherein said trough includes a bottom wall and opposite side walls, and wherein each of said supports is generally U-shaped in outline so as to define a bottom segment and opposite side segments, and wherein said bottom segment and opposite side segments respectively overlie said bottom wall and opposite side walls of said trough.

6. The apparatus as defined in claim 5 wherein said means interconnecting each of said supports to said trough includes an integral inturned lip on each of said supports for engaging the edge of one of said opposite side walls of said trough, and releasable clip means for interconnecting said rod with the edge of the other of said opposite side walls of said trough whereby said trough may be easily removed for repair or replacement.

7. The apparatus as defined in claim 1 wherein each of said fixed supporting brackets includes a segment that extends over and transversely across said trough when in said operative position, and water deflector means mounted on said segment of each of said supporting brackets to deflect any water running along said segments into said trough.

8. The apparatus as defined in claim 1 wherein said rotatable drive means comprises a pulley wheel coaxially attached to said rod, and downwardly hanging belt means supported about said pulley wheel and so as to permit said pulley wheel and rod to be manually rotated from a location below said apparatus.

9. The apparatus as defined in claim 1 wherein said trough includes a bottom wall and opposite side walls, and wherein said rod is positioned along the outside of said side wall of said trough which is remote from the lower edge of the sloped roof, and such that said trough is located between said rod and the lower edge of the sloped roof in its operative position, and is located on the opposite side of said rod in its dumping position.

10. The apparatus as defined in claim 1 wherein said rotatable drive means is constructed so as to rotate the trough downwardly below the rotational axis when the trough is rotated between the operative and dumping positions.

11. An apparatus for receiving rain water from a sloped roof composed of roof sections which intersect each other, and with the roof sections having respective lower edges which intersect each other, and for directing the received rain water to at least one downspout, the apparatus characterized by the ability to be inverted to permit any debris collected therein to fall therefrom, and said apparatus comprising a plurality of fixed supporting brackets mounted at spaced intervals along each of the lower edges of the sloped roof;

first and second elongate rods rotatably supported by said fixed supporting brackets and extending along respective ones of the lower edges of the sloped roof at a spaced distance therefrom, and so as to define first and second rotational axes;

first and second elongate troughs each having a generally U-shape in cross-section and wherein one of said first and second troughs extends around the intersection of the lower edges;

means mounting said troughs to said rod so that the troughs extend parallel to the respective rotational axes of said rod and are rotatable with said rods about said axes; and rotatable drive means connected to said rods for rotating said rods and said troughs about said rotational axes and between an operative position wherein said troughs are upright and in fluid communication with each other and adapted to receive rain water from the lower edges of the roof, and a dumping position wherein said troughs are inverted to permit debris to fall therefrom, and such that the rotational torque is transmitted essentially by said rods and not by said troughs.

12. An apparatus for receiving rain water from the lower edge of a sloped roof and for directing the rain water to a downspout, and characterized by the ability to be inverted to permit any debris collected therein to fall therefrom, said apparatus comprising a plurality of fixed supporting brackets mounted at spaced intervals along the lower edge of the sloped roof;

an elongate rod rotatably supported by said fixed supporting brackets and extending along the lower edge of the sloped roof at a spaced distance therefrom, and so as to define a rotational axis;

an elongate trough having a generally U-shape in cross section so as to define a bottom wall and opposite side walls;

a plurality of supports fixedly mounted to said rod at spaced intervals along said rod and so as to rotate therewith about said rotational axis, wherein said plurality of supports being arranged for mounting said trough to said rod so that said trough extends parallel to said rotational axis of said rod;

rotatable drive means connected to said rod for rotating said rod and said trough about said rotational axis and between an operative position wherein said trough is upright and one of said opposite side walls is adjacent the lower edge of the roof so that the trough receives rain water from the lower edge of the roof, and a dumping position wherein said trough is inverted and moved away from the lower edge of the roof to permit debris to fall therefrom, and such that the rotational torque is transmitted essentially by said rod and not by said trough; and a downspout segment mounted to said bottom wall so as to be in fluid communication with said trough and so as to extend downwardly from said trough in said operative position, said downspout segment includes a flexible lower end portion which is adapted to be received in and communicate with a fixedly mounted downspout entrance receptacle when said trough is in its operative position.

* * * * *